US012245712B1

(12) United States Patent
Cunningham et al.

(10) Patent No.: US 12,245,712 B1
(45) **Date of Patent: *Mar. 11, 2025**

(54) HANGER

(71) Applicant: Classic Décor Ltd., Bowling Green, MO (US)

(72) Inventors: Christopher Eric Cunningham, Lake St. Louis, MO (US); Mark David Cunningham, Lake St. Louis, MO (US)

(73) Assignee: Classic Décor Ltd., Bowling Green, MO (US)

( * ) Notice: Subject to any disclaimer, the term of this patent is extended or adjusted under 35 U.S.C. 154(b) by 353 days.

This patent is subject to a terminal disclaimer.

(21) Appl. No.: 17/903,272

(22) Filed: Sep. 6, 2022

Related U.S. Application Data

(63) Continuation-in-part of application No. 29/820,699, filed on Dec. 23, 2021, which is a continuation-in-part of application No. 16/459,481, filed on Jul. 1, 2019, now Pat. No. 11,253,093.

(60) Provisional application No. 62/694,986, filed on Jul. 7, 2018.

(51) Int. Cl.
*A47G 25/10* (2006.01)
*A47F 7/06* (2006.01)

(52) U.S. Cl.
CPC ..... *A47G 25/10* (2013.01)

(58) Field of Classification Search
CPC ..... A47G 25/10; A47F 7/06
USPC ..... 224/275
See application file for complete search history.

(56) References Cited

U.S. PATENT DOCUMENTS

| | | | | | |
|---|---|---|---|---|---|
| 1,043,671 | A | | 11/1912 | Cloutman | |
| 1,205,615 | A | | 11/1916 | Gebauer | |
| 1,460,081 | A | | 6/1923 | Sommers | |
| 1,990,211 | A | * | 2/1935 | Stinson | A47G 25/24 D6/318 |
| 1,992,359 | A | * | 2/1935 | Didge | A47G 25/10 33/8 |
| 2,146,109 | A | * | 2/1939 | Curtis, Jr. | A47G 25/10 223/66 |
| 2,177,546 | A | * | 10/1939 | Johnson | A47G 25/10 223/66 |
| 2,341,643 | A | * | 2/1944 | Mincenberg | A47G 25/10 223/66 |
| 2,640,594 | A | * | 6/1953 | Lesikar | A47G 25/10 211/32 |

(Continued)

*Primary Examiner* — Nathan J Newhouse
*Assistant Examiner* — Lester L Vanterpool
(74) *Attorney, Agent, or Firm* — Carmody MacDonald P.C.; Dennis J M Donahue, III; Kevin C. Staed

(57) ABSTRACT

The invention is hanger having a hook, an arm, and a bar that is particularly suited for use with a vehicle headrest. The hook has a shank section, a tip section, and a head situated between the shank section and the tip section which. The arm has a proximal section, a distal section, and a bend between the proximal section and the distal section. The proximal section is connected to the shank section of the hook and extends to the bend in the arm opposite from the head of the hook, and the distal section of the arm extends from the bend to a distal end of the arm. The neck of a bar connects to the distal section of the arm with the elongated body of the bar extending to a nose opposite from the neck and items can subsequently be hung from the bar.

17 Claims, 6 Drawing Sheets

(56) References Cited

U.S. PATENT DOCUMENTS 2,643,773 A * 6/1953 Nicholson ..... A47G 25/10 211/32
2,889,935 A * 6/1959 Thornburg ..... A47G 25/10 248/340
3,335,991 A * 8/1967 Epple ..... E06C 7/146 248/303
4,037,737 A * 7/1977 Stevens ..... A47F 5/01 248/303
D256,738 S * 9/1980 Dockery ..... D8/370
4,821,891 A * 4/1989 Williams ..... B60R 7/10 211/181.1
5,033,660 A * 7/1991 Kelly ..... A47F 7/06 211/30
5,169,007 A * 12/1992 McHendry ..... A47F 7/06 211/32
D346,700 S * 5/1994 Weinhold ..... D6/317
5,791,614 A 8/1998 Sims
6,116,481 A * 9/2000 Arnold ..... A47G 25/10 223/1
6,349,862 B1 * 2/2002 Smith ..... A47G 25/10 223/24
6,651,941 B1 11/2003 Kinsel
D570,256 S * 6/2008 Tucker ..... D12/133
7,395,997 B2 * 7/2008 Padden ..... B60N 2/879 294/142
D576,435 S 9/2008 Snell
D673,781 S * 1/2013 Clarke ..... D6/317
D708,447 S * 7/2014 Goodman ..... D6/323
8,944,302 B2 2/2015 Nolan
9,539,949 B2 1/2017 Nuako
10,028,626 B2 7/2018 Harounian
D833,168 S 11/2018 Hussain
10,214,149 B2 2/2019 Nolan
D862,094 S 10/2019 Frushtick
2012/0234782 A1 * 9/2012 Roskuszka ..... B21D 11/10 211/181.1
2014/0110446 A1 * 4/2014 Carter ..... B60R 11/00 224/275
2015/0014472 A1 1/2015 Hussain
2015/0274082 A1 10/2015 Khazadian

* cited by examiner

HANGER

CROSS-REFERENCE TO RELATED APPLICATIONS

This application is a continuation-in-part of U.S. Design patent application No. 29/820,699 filed on Dec. 23, 2021 which is a continuation-in-part of U.S. patent application Ser. No. 16/459,481 filed on Jul. 1, 2019, issued as U.S. Pat. No. 11,253,093 on Feb. 22, 2022, and which claims priority from U.S. Provisional Patent Application No. 62/694,986 filed on Jul. 7, 2018.

STATEMENT REGARDING FEDERALLY SPONSORED RESEARCH

Not Applicable.

APPENDIX

Not Applicable.

BACKGROUND OF THE INVENTION

Field of the Invention

The present invention relates to hangers, and more particularly to hangers that can be mounted to vehicle seats and/or to walls.

Related Art

It has long been a desire to hang items for convenient access and storage in both a home and travel setting. For example, drivers often times do not have adequate storage within a vehicle for personal accessories that they intend to wear, hold or use upon arrival to their destination. Similarly, home users often seek out simple and efficient hanging devices to hang various items around their home or workspace. Accordingly, there remains a desire to those in the art to provide an improved hanger suitable for hanging various everyday personal items like purses and hats as well as miscellaneous items that are frequently used within a home or vehicle like paper towels.

As evidence from U.S. Pat. No. 330,434, hat hangers have been in existence and improved upon since before the passenger motor car had been invented. Further improvements have included the innovation of a hat hanger with a single hook and a closed hoop that are formed from a single strand of wire as documented in U.S. Pat. No. 2,341,643. Another innovation disclosed in U.S. Pat. No. 2,643,773 is for hat hangers held that are by a bracket mounted to a wall and can have alternative arrangements for hanging the hat: in one orientation of the hat hanger, a closed hoop extends downwardly from the bracket so that the hat is held adjacent to the wall with the brim held between the closed hoop and the wall; in an alternative orientation of the hat hanger, the closed hoop extends outwardly away from the wall so that the crown of the hat can be placed upside-down within the closed hoop. A number of hat hanger innovations have been particularly directed to hat hangers that are mounted within vehicles: U.S. Pat. Nos. 2,538,237; 2,916,149, and 9,586,529.

Even with all of these innovations in hat hangers, it remains a common problem for hat wearers to have trouble wearing and properly storing a hat while in a vehicle. Some of the more simple hat hangers that have a single hook and do not require any type of mounting do not satisfactorily hold the hats so the hats fall out of the hat hanger while the vehicle is in motion. Other hat hangers that more securely hold the hat require more complicated installations in the vehicle or are fully integrated into the seats and do not allow the hat hanger to be used with a wall bracket in a home or workplace. Due to some of these hat hanger complexities, the hat hangers also are more expensive than most hat wearers want to spend. Accordingly, many hat wearers resort to putting their hats on the dash of the vehicle or on a seat which causes problems for visibility and passenger space and could damage the shape of the hat.

Similarly, more generic hangers have been developed that drivers and users at home can use to hang and store various items. U.S. Pat. Nos. 5,791,614, 9,539,949, 8,944,302 describe head rest mounted hanging device with individual hooks that can be used to hold various items within a vehicle. However, these designs are each limited to holding items that have a corresponding hook or strap and therefore cannot hold paper towel rolls. Furthermore, these items are particularly designed to attached to the head rest of a vehicle and therefore cannot readily be used in a home setting. Alternatively, U.S. Design Pat. No. D576,435 shows a paper towel hanger that can readily receive a paper towel roll but which cannot be readily used within a vehicle.

Thus, there remains a desire for a hanger that is not complicated to install in a vehicle but securely holds items while the vehicle is moving. There is also a desire for a hanger that can be easily removed from the vehicle or repositioned in the vehicle and preferably can be used interchangeably in a vehicle and at a home and/or workspace.

SUMMARY OF THE INVENTION

In one aspect of the present invention for a hanger, the hanger has a hook, an arm, and a bar. The hook has a shank section, a tip section, and a head situated between the shank section and the tip section. The arm has a proximal section, a distal section, and a bend between the proximal section and the distal section. The proximal section is connected to the shank section of the hook and extends to the bend in the arm opposite from the head of the hook, and the distal section of the arm extends from the bend to a distal end of the arm. The neck of a bar connects to the distal section of the arm with the elongated body of the bar extending to a nose opposite from the neck and items can subsequently be hung from the bar.

In one embodiment, the elongated body of the bar can be a loop with a curved crown section situated between the neck and the nose; the neck is connected to the distal section of the arm at the distal end and is angled out of the plane of the arm to the plane of the loop which is defined by the curved crown section that extends from the neck and turns inwardly back toward the proximal end of the arm, and the nose is situated at an end of the curved crown section opposite from the neck. The neck, the nose, and the curved crown section bound an interior space which receives the crown of the hat, but the nose of the loop does not connect back with the arm and instead provides an open space between nose and the arm. In another embodiment, the elongated body of the bar longitudinally extends between the neck and nose along a longitudinal axis that is parallel to the longitudinal axis of the proximal section of the arm.

In another aspect of the invention, the hanger can be mounted directly to the headrest posts of a vehicle seat without any fasteners required or can be mounted to any seat with an elastic strap with clasps at the ends of the strap. The elastic strap wraps around the seatback and the clasps respectively connect and hold the hanger in place by the hook and bend in the arm. The hanger can alternatively be mounted to a bracket that is secured to a wall by fasteners, without any fasteners required between the hanger and the mounting bracket. With the mounting bracket, the hanger can be oriented so that the bar is spaced outwards from the wall with the elongated body parallel thereto. In yet another aspect of the invention, the hanger is formed from a single, continuous solid strand of wire.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
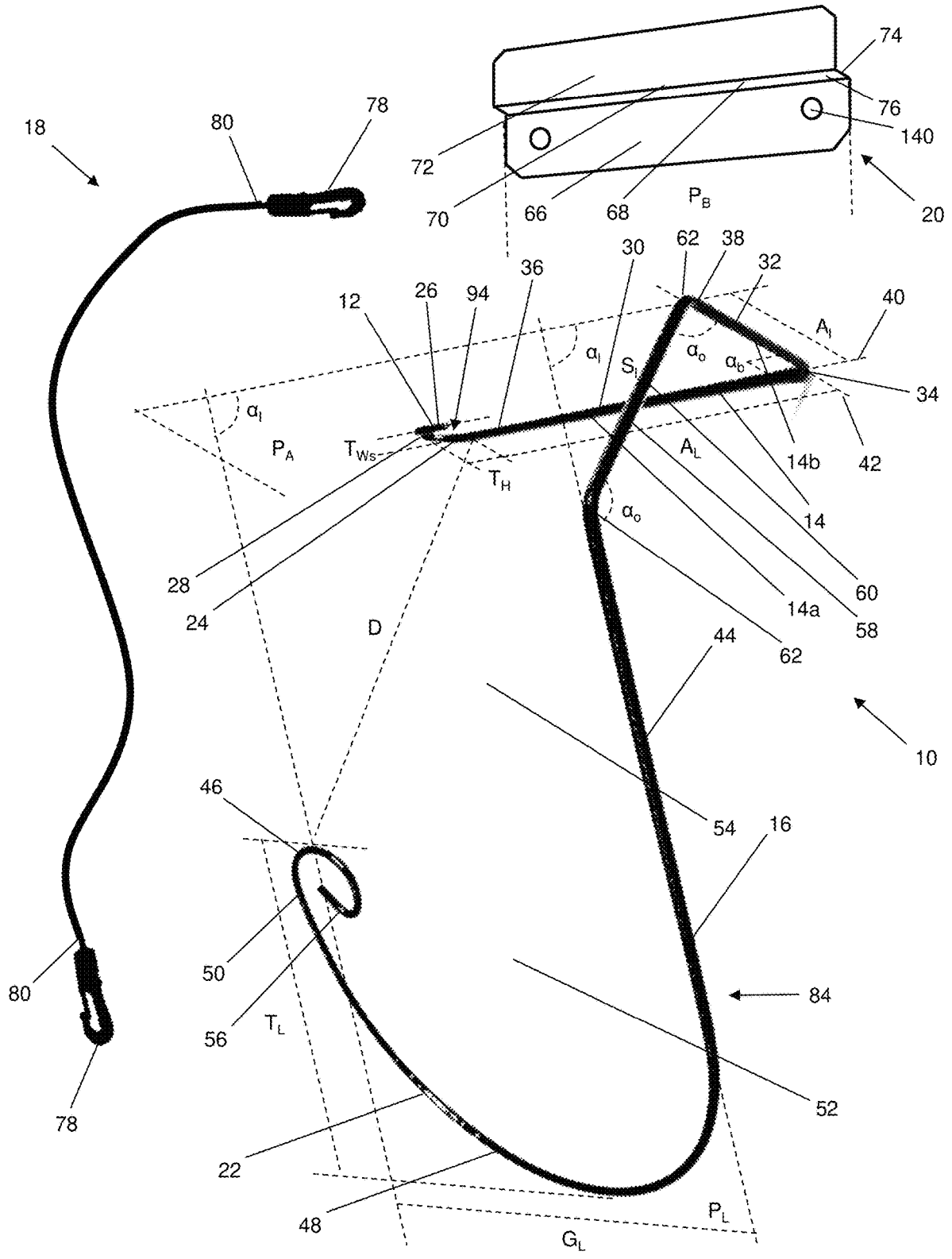
FIG. 1 illustrates a front perspective view of a hanger according to a first embodiment along with alternative mounts, an elastic strap for a seat and a mounting bracket for a wall.
Figure 6:
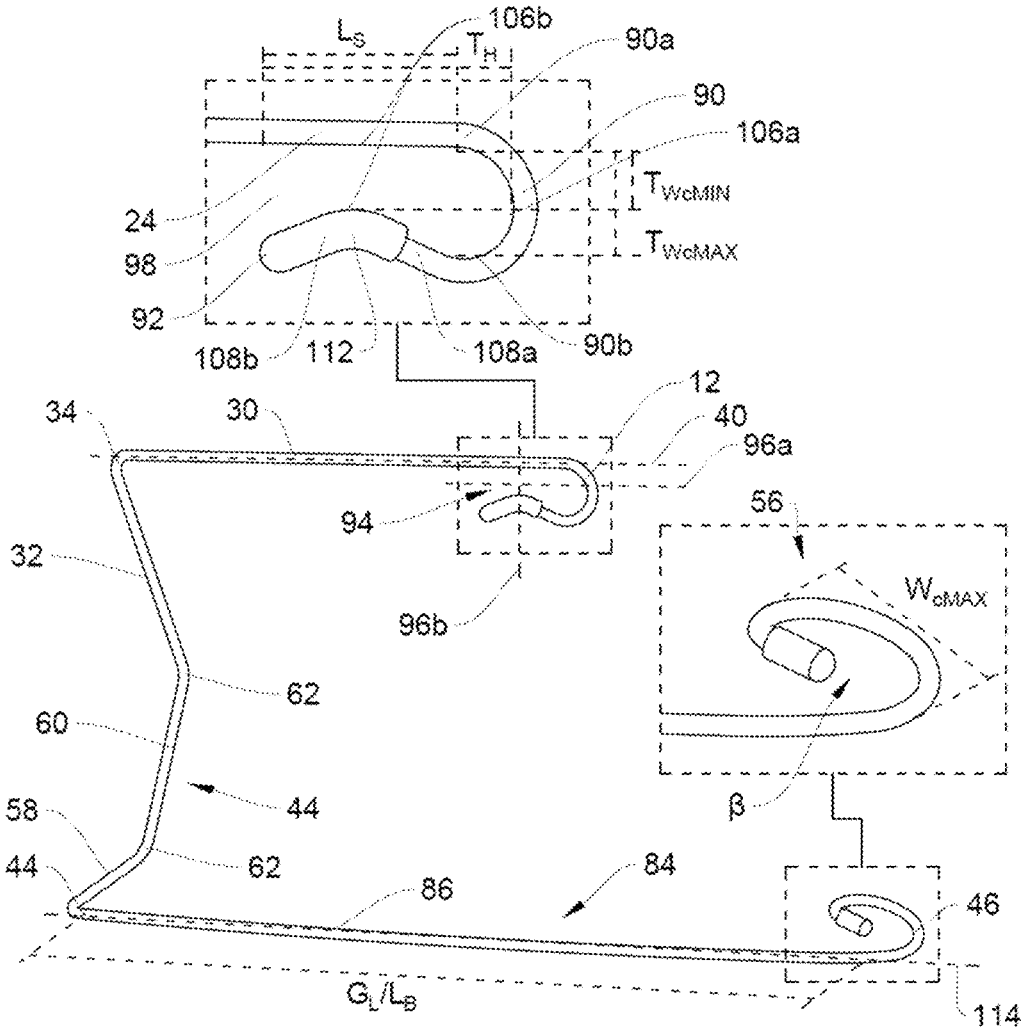
FIG. 6 illustrates a front perspective view of a hanger according to a third embodiment.

The primary elements of the hanger 10 for a hat 100 with mounting devices for the hanger according to the present invention are shown in FIG. 1 and the primary elements of the hanger for a paper towel roll or other fasteners according to the present invention are shown in FIG. 6. Generally, the hanger 10 is formed with a hook 12, an arm 14 and a bar 84 with an elongated body 86 that may be straight 88 or a J-shaped open loop 16. The hook's shank section 24 is connected to the longer end of the arm, i.e., at the proximal end of the longitudinal portion 14*a* away from the arm's lateral portion 14*b*. For embodiments having a J-shaped loop particularly suited for holding hats, the curved crown section 48 of the loop holds the hat while the hook and arm are used to mount the hanger. The bar's neck 44 extends from the elongated body and preferably connects with the arm's lateral portion through an angled segment such that the L-shaped arm is in one plane ($P_A$), and the bar is in another plane ($P_L$) that intersects the arm's plane at an interior angle ($\alpha_I$). Alternatively, straight bar embodiments particularly suited for holding a paper towel roll, clip fasteners and various other items may not include an angled segment such that the bends in the single strand of wire making up the bar, arm and hook keep each portion within the same plane.

Figure 2:
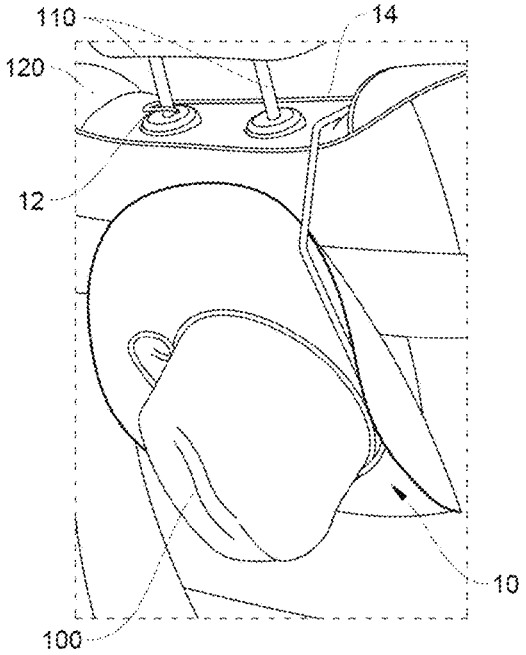
FIG. 2 illustrates the hanger of FIG. 1 mounted to the headrest posts of a vehicle seat.
Figure 3:
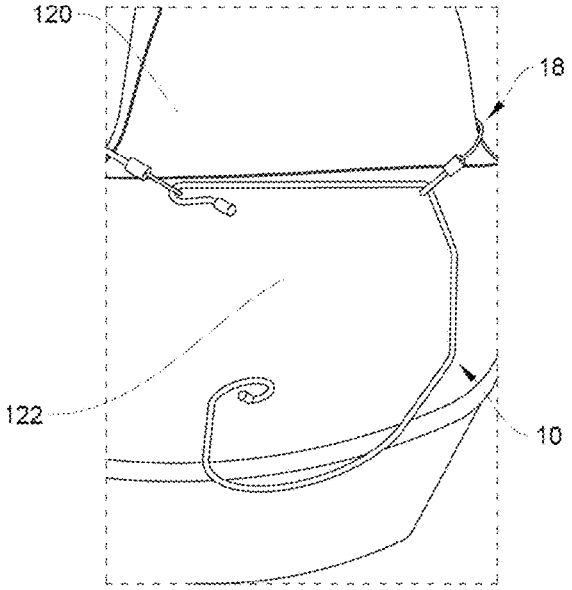
FIG. 3 illustrates the hanger mounted to a seatback of a vehicle seat by the elastic strap illustrated in FIG. 1.
Figure 4A:
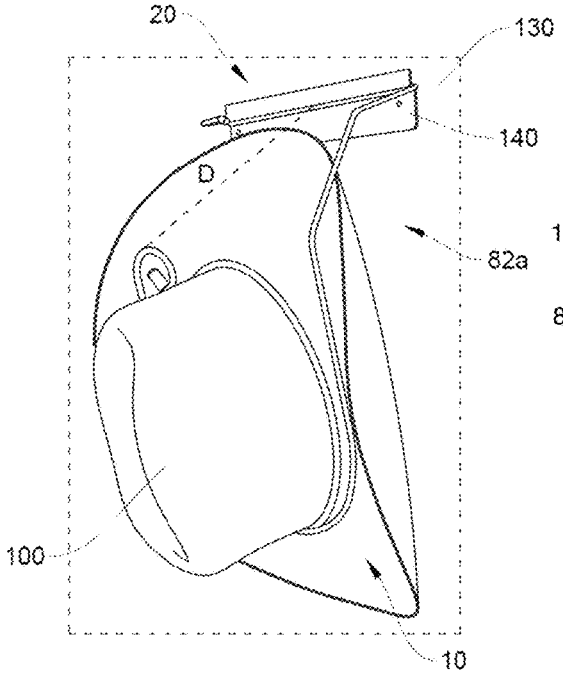
FIGS. 4A and 4B illustrate the hanger mounted to a wall by the mounting bracket illustrated in FIG. 1.
Figure 4B:
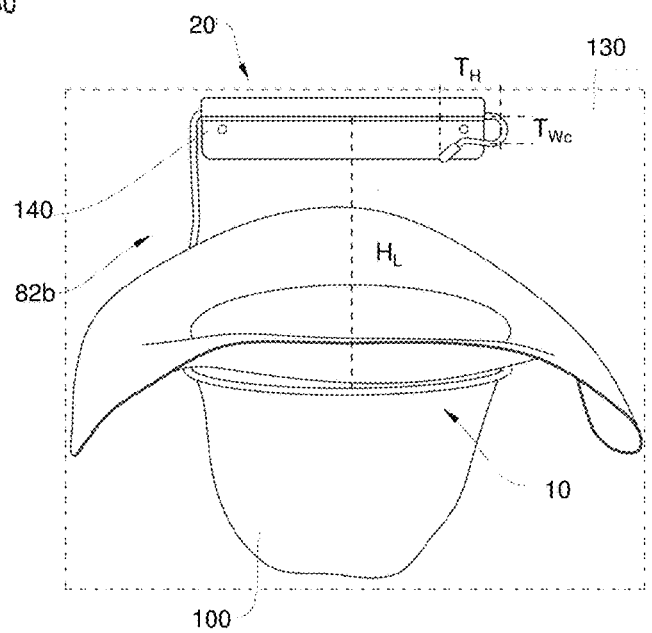
Figure 7A:
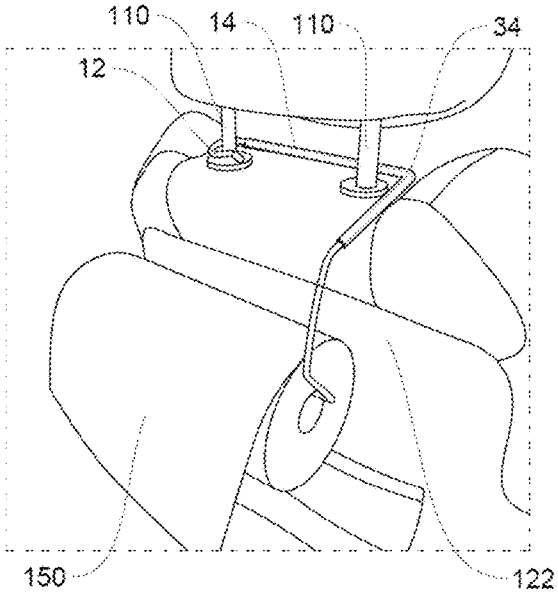
FIGS. 7A and 7B illustrate the hanger of FIG. 6 mounted to the headrest posts of a vehicle seat.
Figure 8A:
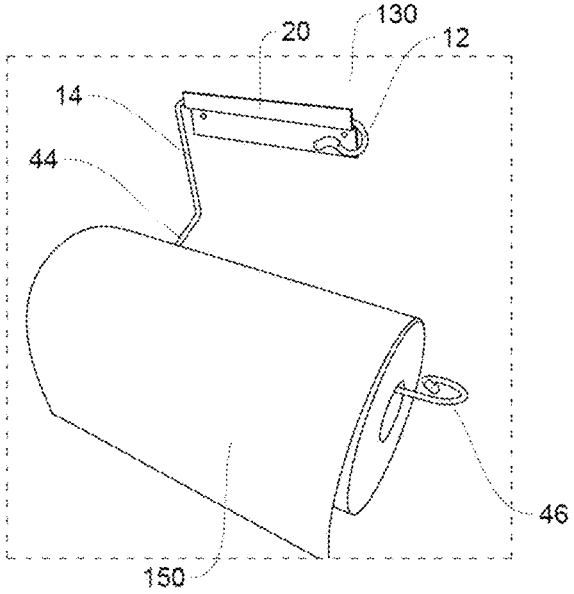
FIGS. 8A and 8B illustrate the hanger of FIG. 6 mounted to a wall by the mounting bracket.
Figure 7B:
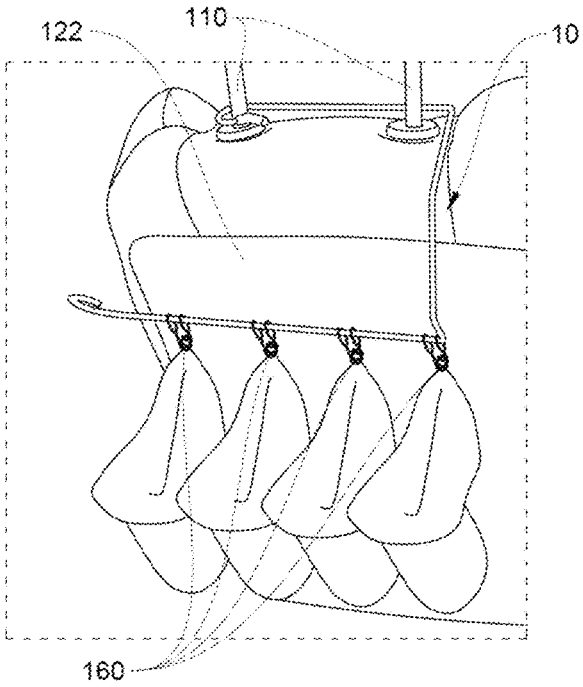
Figure 8B:
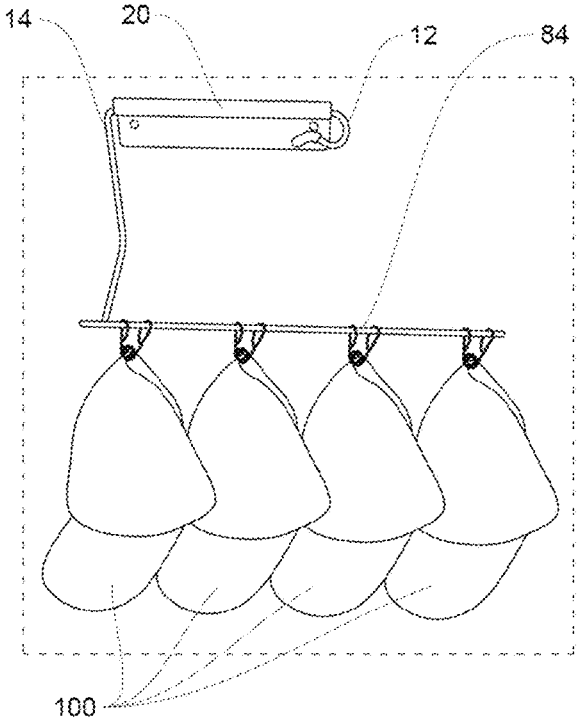

The hanger 10 can be mounted directly onto the headrest posts 110 of a car seat 120 as shown in FIGS. 2, 7A and 7B or may be mounted to seats without headrest posts using an elastic strap 18 as shown in FIG. 3. In FIGS. 2 and 3, the hanger is shown at the backside of the seat 120, and the hanger can alternatively be positioned on the front of the seat. The hanger can also be mounted to a wall 130 with a bracket 20 that is secured to the wall with fasteners 140, such as screws, as shown in FIGS. 4A, 4B, 8A and 8B. With the mounting bracket, the hanger can be positioned with the bar having a loop extending downward toward the wall or with the loop extending outwardly away from the wall as shown in FIGS. 4A and 4B, respectively. Alternatively, the straight bar embodiment can be parallel to the wall but spaced therefrom as shown in FIGS. 8A and 8B. Preferably, the hook, arm, and bar are formed by a single, continuous solid strand of wire 22 that is preferably a metal material which is bent into the hanger shape as particularly described below and shown in the drawings; it will also be appreciated that the hanger could be produced in the inventive shape as a single piece through other manufacturing techniques, such as injection molding or 3D printing/additive manufacturing, or may be produced in separate subassemblies that are fastened together.

The hook 12 has a shank section 24, a tip section 26, and a head 28 situated between the shank section and the tip section. The tip section may be straight, with a longitudinal axis parallel to the arm's longitudinal axis as shown in FIGS. 1 and 2 or may have a converging center portion with a flaring end portion as shown in FIGS. 3, 4 and 6. The converging-flaring tip section could help secure the hook around a headrest post 110 and prevent the hanger 10 from being accidentally dislodged from the posts because the converging section produces a constricted width in the hook with a shorter throat width than for a hook with a straight tip section ($T_{Wc}<T_{Ws}$) as described below. It will also be appreciated that the straight tip section could be less expensive to manufacture and could also provide satisfactory performance in securing the hanger. The end portion of the tip section may also be surrounded a sheath which can help prevent scraping the seat and/or headrest post to which the hanger is attached and may also help secure the hook around the post.

The head of the hook includes a curvature 90 between a shank end 90*a* and a tip end 90*b* with the shank section extending the shank length (Ls) from the shank end of the head to the arm and the tip section extending the tip length from the tip end of head to a terminal end 92. The head, tip section and shank section collectively bound the throat 94 of the head with the throat length ($T_H$) measured along the center longitudinal axis 96*a* of the hook from the inner wall 106*a* of the head to the throat opening 98 between the terminal end of the tip and end of the shank section opposite from the head. As referenced above, the throat also includes a throat width ($T_{Wc}$, $T_{Ws}$) measured along the lateral axis 96*b* of the hook from the opposing inner walls 106*b* of the shank section and the tip section which is not necessarily uniform along the length of the throat.

In embodiments of the hook having a converging-flaring tip section 108, an inflection point 112 is positioned between a converging portion 108*a* of the tip section that is angled towards the shank section and a flaring portion 108*b* of the tip section that is angled away from the shank section. As particularly shown in the detail view of FIG. 6, the converging portion is situated between the tip end of the head and the inflection point and the flaring portion is situated between the inflection point and the terminal end of the tip section. The throat width therefore changes relative to the converging-flaring tip sections with the throat width at the inflection point being the minimum throat width ($T_{W_{cMIN}}$) and the maximum throat width ($T_{W_{cMAX}}$) at a lateral cross-section aligned with at least one of the throat opening and the space between the ends of the head. Accordingly, the throat width at the inflection point is less than the throat width at any location along the converging-flaring tip sections away from the inflection point. The preferred maximum throat width is at least twice the minimum throat with but less than the throat length. ($2*T_{W_{cMIN}}>T_{W_{cMAX}}>T_H$).

With the converging-flaring tip sections gripping the head rest of the vehicle when used therein, it will be appreciated that the hook of the invention described herein can securely attached the hanger to the headrest without additional fasteners regardless of the dimensions of the headrest itself. Thus, the hanger can be a uniform size and does not require any adjustment by the user when installing the hanger in the vehicle. Instead, the proximal section of the arm spaces the bend far enough away from the hook that at least a portion of the bend or proximal section of the hook contacts the opposite post from the post which engages the hook and the weight of the item being held hold the arm in place.

Figure 5:
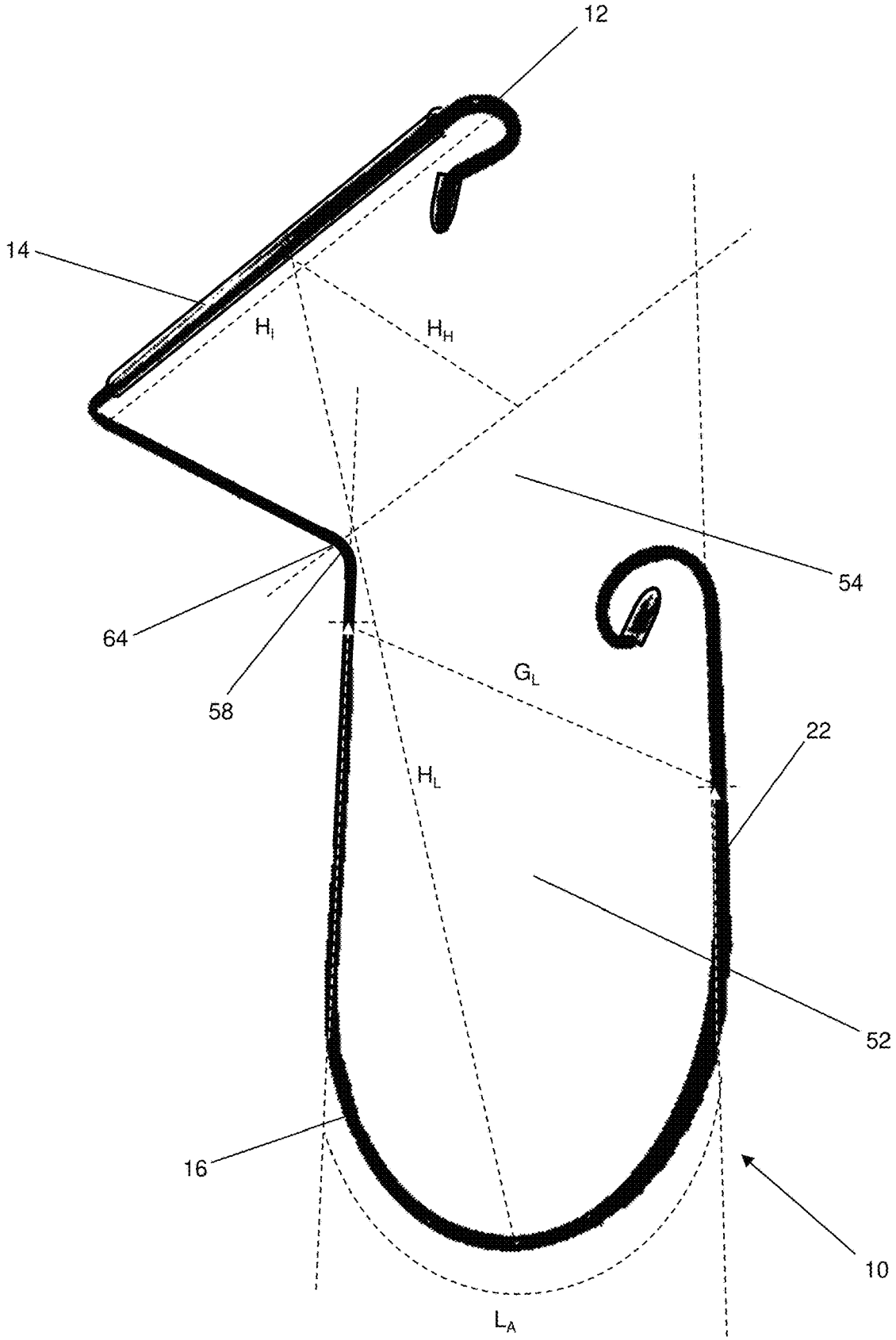
FIG. 5 illustrates a back perspective view of a hanger according to a second embodiment.

The arm 14 has a proximal section 30, a distal section 32, and a bend 34 between the proximal and distal sections. The proximal section is a longitudinal portion 14*a* of the arm that is connected to the shank section 24 of the hook 12 at a proximal end 36 of the arm and extends longitudinally for a length ($A_L$) from the proximal end to the bend in the arm opposite from the head of the hook. The distal section is a lateral portion 14*b* of the arm that extends for a length ($A_l$) from the bend to a distal end 38 of the arm. The hook's throat length ($T_H$) is preferably greater than half of the arm's lateral length and less than the arm's total lateral length ($A_l>T_H>½A_l$), and the arm's lateral length is preferably less than half the arm's longitudinal length ($A_l<A_L$). Each part of the arm is situated in a plane ($P_A$) that is defined by the longitudinal axis 40 of the arm's proximal section 30 and the lateral axis 42 of the arm's distal section 32, i.e., the longitudinal and lateral portions of the arm that have an angle of the bend (ab) between them. The shank section, tip section, and the head of the hook are also preferably situated in the plane of the arm. As shown in FIGS. 5 and 6, the longitudinal portion of the arm may optionally be surrounded by a cylindrical sheath.

The hanger also includes a bar with a neck 44, a nose 46 and a body situated between the neck and the nose. The neck is connected to the distal section 32 of the arm at the distal end 38 and the nose is situated at the opposite end 86 of the body. Accordingly, there is a gap length ($G_L$) between the neck and the nose.

In the embodiments of the hanger shown in FIGS. 1-5, the bar has a loop body 16 with and a curved crown section 48 situated between the neck and the nose. The curved crown section extends from the neck and turns inwardly, back toward the proximal end of the arm rather than outwardly away from the proximal end of the arm. The nose is situated at the furthest end 50 of the crown opposite from the neck so that by turning the crown inwardly, the nose is positioned closer to the proximal end of the arm whereas if the crown had been turned outwardly, the nose would be positioned further away from the proximal end of the arm. The neck, nose, and crown bound an interior space 52 of the loop, and the loop has a throat length ($T_L$) that is longer than the arm's lateral length ($T_L>A_l$), and the loop's gap length ($G_L$), measured between the neck and the nose, is preferably greater than the arm's lateral length and is less than the combined length of the arm's longitudinal length and the hook's throat length ($T_H+A_L>G_L>A_l$). The loop's gap length preferably has a span that is slightly greater than the arm's longitudinal length ($G_L>T_H$) so that the crown's midpoint (located at its furthest edge) is nearly aligned with the midpoint of the arm's longitudinal portion. The alignment of the midpoints of the crown and the arm (best shown in FIGS. 4B and 5) helps keep the hanger stabilized, providing an even distribution of the weight of the hat and loop and avoiding imbalances that might otherwise cause the hanger to rock, especially in a moving vehicle, which could result in the hanger losing its grip on the hat and the hat falling from the hanger. The nose does not connect back with the arm and instead is spaced a distance (D) apart from the arm's proximal end which produces an open space 54 between the loop's interior space 52 and the arm's proximal section 30. The nose preferably includes a curl 56 that curves inwardly into the loop's interior space.

In the alternative embodiments shown in FIGS. 6-8, the bar has an elongated straight body between the neck and the nose rather than a curved crown. Accordingly, the gap length between neck and the nose is equal to the length of the body ($L_B=G_L$) and the distance (D) between the nose and the arm's proximal end produces an open space 54 between the straight body and the arm's proximal section. Conversely, the arc length ($L_A$) of the curved crown in embodiments with a loop would be greater than the gap length ($L_A>G_L$). In the straight body embodiment the body of the bar extends along a longitudinal axis 114 that is parallel to the longitudinal axis of the proximal section of the arm 40 and perpendicular to the lateral axis of the distal section of the arm. Although the particular dimensions of the arm and bar are not intended to be limiting, the longitudinal length ($A_L$) of the proximal section of the arm is at least half the length of the gap between the neck and the nose ($A_L>½G_L$) and the lateral length of the distal section of the arm ($A_l$) no more than half the length of the proximal section of the arm ($A_l<½A_L$).

As with the arm with a looped body, the neck of the straight body in the preferred embodiment is angled out of the plane of the arm. With the neck angled out of plane of the arm, the body of the arm is situated in a plane ($P_L$) that forms an interior angle ($\alpha_I$) at an intersection with the arm's plane ($P_A$). The interior angle is preferably acute so that the body plane angles back toward the seatback 122 when the hanger is positioned on the headrest posts 110, but the interior angle may be a right angle or slightly obtuse. The neck 44 may also include an angled segment 58 that extends a length between the arm's plane and the body plane to connect the arm's distal section 32 with the body 48 at the interior angle. As particularly shown in FIGS. 1-4, the angled segment may have a straight section 60 between a pair of bends 62 that form a pair of obtuse interior angles ($\alpha_o>90°$) with the respective planes. The length of the angled segment's straight section ($S_l$) is preferably greater than the arm's lateral length and is less than the arm's longitudinal length ($A_L>S_l>A_l$). Alternatively, as shown in FIG. 5, the angled segment 58 may be formed with a single continuous bend 64 between the arm's distal section 32 and the body of the arm, and in this version of the hanger, the angled segment would not have any straight section. As also shown in FIG. 5, a cylindrical sheath preferably made from a soft, pliable plastic or rubber material surrounds most of the arm's longitudinal portion.

Figure 9:
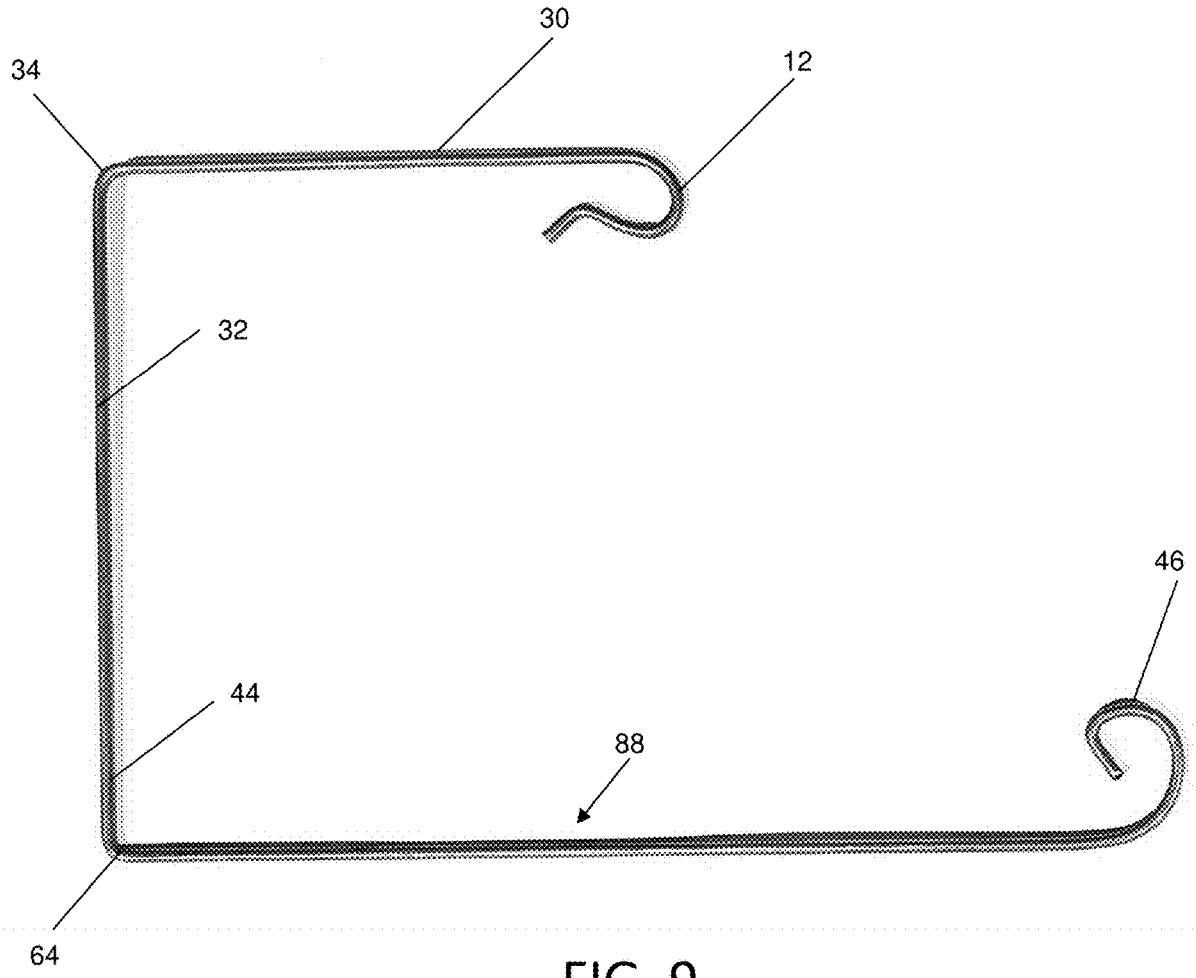
FIG. 9 illustrates a front perspective view of a hanger according to a fourth embodiment.

In an alternative embodiment, the bar may be positioned within the same plane as the arm without any bend in the neck that moves the body into a different plane. As shown in FIG. 9, the neck can attach to the end of the distal section of the arm and angle the body of the neck away from the distal end of the distal section without any angled segment moving the body out of the arm plane. Thus, the body is parallel to the proximal section of the arm and spaced therefrom by the distal section of the arm but the entire hanger is bent within a single plane.

The wall mounting bracket 20 has a flat panel 66 that is fastened to the wall 130. A shelf section 68 extends outward from the flat panel to a cantilevered end 70, and a flange 72 projects from the cantilevered end. When the bracket is fastened to the wall, the plane of the bracket's flat panel ($P_B$) is adjacent to and parallel with the plane of the wall. As indicated above and shown in FIGS. 4A and 4B, different orientations of the hanger 10 on the bracket 20 result in alternative configurations of the hanger and the bracket. In both configurations, the arm's proximal section 30 lays on the shelf section's topside 74 between the flat panel and the flange, and the hook's tip section 26 is positioned on the opposite side 76 of the shelf section that is underneath the topside and the arm's proximal section laying on the shelf. In the configuration 82*a* shown in FIG. 4A, the arm's distal section 32 is angled away from the bracket's flat panel plane ($P_B$), and the loop's curved crown section 48 is angled back towards the bracket's flat panel plane. In the other configuration 82*b* shown in FIG. 4B, the hanger 10 is flipped (i.e., rotated 180° relative to the vertical axis of the wall) so that the arm's distal section lays adjacent to the bracket's flat panel plane, and the loop's curved crown section is angled away from bracket's flat panel plane. It will be appreciated that in the latter configuration 82*b*, the hook may engage the flat panel and prevent the arm's distal section from contacting the wall which can protect the wall from being damaged by an indentation of the arm when a hat is placed in the crown.

The elastic strap 18 can be used to mount the hanger 10 to seatbacks 110 which do not have headrest posts. The elastic strap has fasteners 78 attached to opposite ends 80 of the strap. The elastic strap wraps around the seatback, and the fasteners respectively connect to the hook and to the bend in the arm to secure the hanger to the seat. Preferably, the fasteners are clasps such as halter snaps or snap hooks, and it will be appreciated that other similar spring-biased clasps could be used for the strap's fasteners, including lobster clasps, bolt snaps, carabiners, lever snaps, and trigger snaps. Different types of fasteners could also be used on the ends of the strap, such as hook and loop fasteners and buckles.

The operation of the hanger 10 is similar for the mounting arrangements shown in FIGS. 2, 3, 4A, 7A, 7B, 8A and 8B in which the hook 12 and the arm 14 hold the hanger to either the seat 120 or the wall 130, and a user rotates the body away from the seat or the wall to place the item on the body, such as inserting a paper towel roll 150 onto the nose of the straight body or setting the crown 102 of the hat in the interior space 52 of the loop. For a hanger with a looped body, with the brim 104 of the hat positioned on the side of the loop's crown 48 that faces towards the arm, the hat wearer/user allows the loop and hat to rotate back towards the seat or the wall, and the hat's crown is held by the hanger with the brim of the hat positioned between the loop and the seat or the wall. To remove the hat from the hanger or reposition the hat in the hanger, the loop is rotated away from the seat or wall allowing the crown of the hat to be moved within or removed from the interior space of the loop.

When the hanger is used with seats 120 that have headrest posts 110, a user does not require any fasteners or other mounting devices so the hanger can quickly be removed or repositioned based on a user's desires. For seats that do not have headrest posts, the elastic strap 18 with fasteners can be quickly positioned around the seatback 122 which also allows for quickly removing or repositioning the hanger on the seat. Additionally, once the mounting bracket 20 is fastened to the wall 130 or similar supporting structure, the hanger is readily portable so it can be interchangeably used in the user's vehicle and at the user's home and/or workspace. As evident from the interchangeable orientations of the hanger in the bracket fastened to the wall, the hanger with a loop particularly suited for holding a hat can hold the hat with the brim facing towards the wall or upwards. Similarly, the hanger with a straight body can also be oriented with open space between the bar and arm orientated in either direction. For example, the hanger can be used with the mounting bracket at the corner of a wall with the open space facing outwardly from the corner to allow a paper towel to be inserted onto the bar. Similarly, the hanger can be oriented in the car with the open space facing outwardly towards the window of the vehicle or interiorly towards the opposite side of the vehicle.

The curl 56 in the nose of the loop 16 can be useful in holding hardhats, baseball caps, and other hats that have internal suspension structures and/or straps but do not have a brim around the sides of the crown. In particular, the suspension structures and straps can be held by the curl. The preferred curl has a bend (β) that is greater than a right-angle curve (>90°) and is preferably a spiral that curves back around toward the arm and bar (i.e. between a 180°-270° bend). The preferred curl is also wider than the throat as shown in the drawings such that the maximum width of the curl ($W_{cMAX}$) is greater than the maximum throat width ($W_{cMAX}>T_{W_{cMAX}}$). The loop can also be used to hold purses or grocery sacks to keep them organized in addition to functioning as a stopper at the end of the straight bar to prevent the paper towel roll or other items held on the straight bar from sliding off the nose of the bar.

Fasteners 160 may also be releasably secured to the body of the bar to hold multiple items from a single hanger. For example, clips with loops are shown in FIGS. 7B and 7B with the loop end of each fastener received on the straight body of the arm such that the clip end, and hats clipped thereto, are suspended beneath the bar. Although the clips with loops are shown, it will be appreciated that other fastener types may also be used including clothespins, coat hangers and the like.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the hanger is sized for standard sized hats, it will be appreciated that the hanger's size could be varied with the various elements being sized proportionally. Thus, the breadth and scope of the present invention should not be limited by any of the above-described exemplary embodiments, but should be defined only in accordance with the following claims appended hereto and their equivalents.

What is claimed is:

1. A hanger, comprising:

a hook comprising a shank section, a tip section, and a head situated between the shank section and the tip section;

an arm comprising a proximal section, a distal section, and a bend between the proximal section and the distal section, wherein the proximal section is connected to the shank section of the hook at a proximal end of the arm and extends for a first length from the proximal end to the bend in the arm opposite from the head of the hook, wherein the distal section of the arm extends for a second length from the bend to a distal end of the arm, and wherein the arm is situated in a first plane; and a bar comprising a neck, a nose and a body situated between the neck and the nose, wherein the neck is connected to the distal section of the arm at the distal end and is angled out of the first plane, wherein the body is situated in a second plane forming an interior angle with the first plane, wherein the neck further comprises an angled segment extending between the first plane and the second plane, wherein a first obtuse interior angle is formed between the angled segment and the first plane, wherein a second obtuse interior angle is formed between the angled segment and the second plane, and wherein the nose is situated at an end of the body opposite from the neck.

2. The hanger of claim 1, wherein the head comprises a curvature between a shank end and a tip end, wherein the shank section extends for a shank length from the shank end of the head to the proximal section of the arm, wherein the tip section extends for a tip length from the tip end of the head to a terminal end of the tip section, and wherein the hook further comprises a throat having a throat opening between the terminal end of the tip section and the shank section, a throat length between the throat opening and the head, and a throat width between the shank section and the tip section.

3. The hanger of claim 2, wherein the tip section further comprises a converging portion angled towards the shank section, a flaring portion angled away from the shank section, and an inflection point between the converging portion and the flaring portion, wherein the converging portion is situated between the tip end of the head and the inflection point, wherein the flaring portion is situated between the inflection point and the terminal end of the tip section, and wherein the throat width at the inflection point of the tip section is less than the throat width along the converging portion and the flaring portion of the tip section.

4. The hanger of claim 3, wherein the throat width comprises a maximum throat width at a location spaced away from the inflection point that is at least twice the throat width at the inflection point, wherein the maximum throat width is less than the throat length, wherein the nose further comprises a curl with a bend that is greater than 90°, and wherein a maximum curl width is greater than the maximum throat width.

5. The hanger of claim 1, wherein the bend of the proximal section of the arm extends for the first length along a first longitudinal axis, wherein the distal section of the arm extends the second length along a lateral axis that is perpendicular to the first longitudinal axis, wherein the neck of the bar is spaced from the nose of the bar by a third length, wherein the first length is at least one-half the third length, and wherein the second length is less than one half the first length.

6. The hanger of claim 5, wherein the body of the bar extends for the third length along a second longitudinal axis that is parallel to the first longitudinal axis.

7. The hanger of claim 5, wherein the body of the bar further comprises a curved crown section having an arc length between the neck and the nose, wherein the curved crown section extends an arc length from the neck and turns inwardly back toward the proximal end of the arm, wherein the neck, the nose, and the curved crown section bound an interior space, and wherein the arc length is greater than the third length.

8. The hanger of claim 1, wherein the hook, the arm, and the bar are all formed from a single, solid strand of wire, and wherein the hook is situated within the first plane.

9. The hanger of claim 2, further comprising a plurality of fasteners releasably secured to the body of the bar, wherein the nose of the loop further comprises a curl, wherein a maximum curl width is greater than a maximum throat width, and wherein the curl is comprised of a spiral curving back towards the arm and the bar.

10. The hanger of claim 1, further comprising a wall mounting bracket, wherein the wall mounting bracket comprises a flat panel in a third plane, a shelf section extending outward from the flat panel to a cantilevered end, and a flange projecting from the cantilevered end of the shelf section, wherein the proximal section of the arm lays on the shelf section between the flat panel and the flange, and wherein tip section of the hook is positioned on an opposite side of the shelf section from the proximal section of the arm.

11. A hanger, comprising:

a hook comprising a shank section, a tip section, and a head situated between the shank section and the tip section, wherein the hook further comprises a throat between the shank section and the tip section having a throat length and a throat width, wherein the tip section further comprises a converging portion angled towards the shank section, a flaring portion angled away from the shank section, and an inflection point between the converging portion and the flaring portion, wherein the throat width comprises a maximum throat width at a location spaced away from the inflection point that is at least twice the throat width at the inflection point, wherein the maximum throat width is less than the throat length, and wherein the throat width at the inflection point is less than the throat width along the converging portion and the flaring portion;

an arm comprising a proximal section, a distal section, and a bend between the proximal section and the distal section, wherein the proximal section is connected to the shank section of the hook at a proximal end of the arm and extends for a first length along a first longitudinal axis from the proximal end to the bend in the arm opposite from the head of the hook, wherein the distal section of the arm extends for a second length along a lateral axis from the bend to a distal end of the arm, and wherein the first longitudinal axis is perpendicular to the lateral axis; and a bar comprising a neck, a nose and a body situated between the neck and the nose, wherein the neck is connected to the distal section of the arm at the distal end, wherein the nose is situated at an end of the body opposite from the neck, wherein the body extends for a third length along a second longitudinal axis from the neck to the nose, wherein the second longitudinal axis is parallel to the first longitudinal axis, and wherein the first length is at least one half the third length, wherein the nose further comprises a curl with a bend that is greater than 90°, wherein a maximum curl width is greater than the maximum throat width, and wherein the curl is comprised of a spiral curving back towards the arm and the bar.

12. The hanger of claim 11, wherein the arm is situated within a first plane and the neck is angled out of the first plane, wherein the body is situated in a second plane forming an interior angle with the first plane, wherein the neck further comprises an angled segment extending between the first plane and the second plane, wherein a first obtuse interior angle is formed between the angled segment and the first plane, and wherein a second obtuse interior angle is formed between the angled segment and the second plane.

13. The hanger of claim 11, wherein the throat further comprises a throat opening between a terminal end of the tip section and the shank section, and wherein the maximum throat width is located at the throat opening.

14. A hanger, comprising:

a hook comprising a shank section, a tip section, and a head situated between the shank section and the tip section, wherein the hook further comprises a throat between the shank section and the tip section having a throat length and a throat width, wherein the tip section further comprises a converging portion angled towards the shank section, a flaring portion angled away from the shank section, and an inflection point between the converging portion and the flaring portion, and wherein the throat width at the inflection point is less than the throat width along the converging portion and the flaring portion;

an arm comprising a proximal section, a distal section, and a bend between the proximal section and the distal section, wherein the proximal section is connected to the shank section of the hook at a proximal end of the arm and extends along a first longitudinal axis for a first length from the proximal end to the bend in the arm opposite from the head of the hook, and wherein the distal section of the arm extends along a lateral axis that is perpendicular to the first longitudinal axis or a second length from the bend to a distal end of the arm; and a bar comprising a neck, a nose and a body situated between the neck and the nose, wherein the neck is connected to the distal section of the arm at the distal end, wherein the nose is situated at an end of the body opposite from the neck, wherein the neck of the bar is spaced from the nose of the bar by a third length, wherein the first length is at least one-half the third length, and wherein the second length is less than one half the first length.

15. The hanger of claim 14, wherein the throat width comprises a maximum throat width at a location spaced away from the inflection point that is at least twice the throat width at the inflection point, wherein the maximum throat width is less than the throat length, wherein the nose further comprises a curl with a bend that is greater than 90°, wherein a maximum curl width is greater than the maximum throat width, and wherein the curl is comprised of a spiral curving back towards the arm and the bar.

16. The hanger of claim 14, wherein the body of the bar extends for the third length along a second longitudinal axis that is parallel to the first longitudinal axis.

17. The hanger of claim 14, wherein the body of the bar further comprises a curved crown section having an arc length between the neck and the nose, wherein the curved crown section extends an arc length from the neck and turns inwardly back toward the proximal end of the arm, wherein the neck, the nose, and the curved crown section bound an interior space, and wherein the arc length is greater than the third length.

* * * * *